US006045490A

United States Patent [19]

Shafer et al.

[11] Patent Number: 6,045,490

[45] Date of Patent: Apr. 4, 2000

[54] MOTORIZED EXERCISE TREADMILL

[76] Inventors: Terry C. Shafer, 142 Wind Ridge Cir., Woodlands Montgomery County, Tex. 77381; Mark E. White, 6239 E. Hawthorne St., Tucson Pima County, Ariz. 85711

[21] Appl. No.: 08/988,189

[22] Filed: Dec. 10, 1997

[51] Int. Cl.[7] ..... A63B 23/00

[52] U.S. Cl. ..... 482/54; 482/51

[58] Field of Search ..... 482/51, 54

[56] References Cited

U.S. PATENT DOCUMENTS

| | | | |
|---|---|---|---|
| 2,135,082 | 11/1938 | Kelly | 482/54 |
| 3,659,845 | 5/1972 | Quinton | 482/54 |
| 4,502,679 | 3/1985 | De Lorenzo . | |
| 4,566,689 | 1/1986 | Ogden . | |
| 4,602,779 | 7/1986 | Ogden . | |
| 4,928,956 | 5/1990 | Chen . | |
| 4,944,713 | 7/1990 | Salerno . | |
| 5,034,576 | 7/1991 | Dalebout et al. . | |
| 5,062,632 | 11/1991 | Dalebout et al. | 482/54 |
| 5,110,117 | 5/1992 | Fisher et al. . | |
| 5,184,988 | 2/1993 | Dunham | 482/54 |
| 5,336,145 | 8/1994 | Keiser . | |
| 5,383,828 | 1/1995 | Sands et al. . | |
| 5,431,612 | 7/1995 | Holden | 482/54 |
| 5,433,679 | 7/1995 | Szymcazk et al. . | |
| 5,441,467 | 8/1995 | Stevens . | |
| 5,441,468 | 8/1995 | Deckers et al. | 482/54 |
| 5,476,430 | 12/1995 | Lee et al. | 482/54 |
| 5,512,025 | 4/1996 | Dalebout et al. . | |
| 5,518,471 | 5/1996 | Hettinger et al. . | |
| 5,558,604 | 9/1996 | Hopkins . | |
| 5,558,605 | 9/1996 | Gvoich | 482/54 |
| 5,618,245 | 4/1997 | Trulaske et al. . | |
| 5,626,538 | 5/1997 | Dalebout et al. . | |

*Primary Examiner*—Glenn E. Richman
*Attorney, Agent, or Firm*—Baker & Botts, L.L.P.

[57] ABSTRACT

A motorized treadmill that provides more fluid rotational motion of the treadmill belt, increases the life of the motor, provides more stable and reliable elevation of the treadmill, and provides automatic dampening for users of all weight ranges. The treadmill includes an external frame having first and second longitudinal side rails and at least one frame cross-bar extending therebetween, and an upright frame section that extends upwardly from a first end of the longitudinal side rails. First and second rollers are rotatably mounted on the external frame and positioned so as to be substantially perpendicular to the longitudinal side rails. The first roller is coincident with a first axis. A deck is mounted on the external frame and positioned between the first and second rollers and the longitudinal side rails. An endless belt is mounted around and extends between the first and second rollers for rotation therewith. A motor assembly including a motor, and a motor shaft that is coincident with a second axis and is rotatably driven by the motor, is rotatably coupled to the first roller for rotatably driving the first roller. The treadmill also includes a flywheel assembly that is mounted on the external frame and includes a flywheel fixedly mounted on a flywheel shaft that is coincident with a third axis. The flywheel assembly is coupled to and rotatably driven by the motor assembly.

22 Claims, 5 Drawing Sheets

MOTORIZED EXERCISE TREADMILL

FIELD OF THE INVENTION

The present invention relates to a motorized treadmill, and more specifically to a motorized treadmill having various advantageous features such as a unique flywheel assembly that both improves the rotational motion of the treadmill belt and also reduces the load on the motor; a unique elevation system that is more reliable, and provides superior stability and lifting power; an automatic dampening system that automatically dampens the impact of a user's step on the treadmill deck for users in all weight ranges; and retractable handrails.

BACKGROUND

The use of motorized treadmills has become increasingly popular for fitness as well as for various therapeutic purposes. In a typical motorized treadmill, an endless belt travels around two parallel and spaced apart cylindrical rollers, with at least one roller being directly driven by the motor. A support deck located beneath the endless belt supports the belt and the user when the treadmill is in operation. Further, known treadmills have either no support bars, or more typically, have rigid support bars or handrails positioned on either side of the belt to provide a balancing aid for the user. An additional feature of many treadmills today is an elevation system that enables the user to increase the incline of the treadmill, thereby increasing the exercise difficulty level.

The motor that drives the treadmill typically has a flywheel mounted on the motor shaft for improving the rotational motion of the belt. Under normal use, a greater load is imposed on the motor during those times that the user is stepping down on the belt, as opposed to when the user is not stepping down, such as during the brief periods between steps. Stepping down slows down the motor and may lead to a jerky movement of the belt that is noticeable to the user. The flywheel is an additional mass that is rotating with the motor shaft, therefore providing additional inertial forces that counteract the tendency of the motor to slow down each time the user's foot contacts the belt. Because the flywheel is mounted on the motor shaft, however, it creates an overhang load on the motor shaft. This imposes an additional load on the motor bearings and reduces the life of the motor, and also imposes an additional load on the electronics and power supplies that govern operation of the treadmill. In addition to the overhang load, the motor also experiences significant unidirectional loading from driving the treadmill rollers. Since the life of a motor is related to the loads imposed on it, the need exists for a motorized treadmill in which these loads are substantially reduced. Further, it would be desirable to provide a treadmill having a flywheel assembly that further improves the fluid rotational motion of the belt.

As indicated above, many treadmills also include an elevation system. One existing type of elevation systems consists of a single motor and gear unit, such as a single motor mounted in the front center region of the treadmill that drives a linear actuator to lift up the front end of the treadmill. Such a system is typically mounted on the treadmill at only two points, one on either side of the motor and gear unit, and therefore tends to wobble under use. Further, the single motor and gear unit provides only a limited lifting force. Another typical elevation system consists of a motor mounted in the front center region of the treadmill that simultaneously drives two linear actuators that are mounted in the front right and front left corner regions of the treadmill. Although this type of system improves the stability of the treadmill and provides additional lifting power, the two linear actuators must be driven in synchrony by the motor to lift the treadmill belt in a level manner. In operation, such synchrony is difficult to achieve, and if one of the linear actuators fails to function properly the entire elevation system may bind up and cease to function, making periodic cleaning and maintenance necessary. Accordingly, a need exists for a treadmill elevation system that provides sufficient lifting power and stability, and that is not subject to the limitations described above.

Another area for improvement in treadmill design involves providing a more comfortable running or walking plane that will dampen or cushion the impact of the force exerted on the deck by a user. A suspended deck is a widely used dampening system. Dampening mechanisms thus far, however, have been unable to provide a dampening system that will account for the vast differences in weight of treadmill users. This aspect is particularly important for treadmills that are used by the general public, such as those in fitness clubs. For example, many types of suspended decks will comfortably dampen the stepping force of a 180 or 200 pound person, but will not provide sufficient dampening for a 100 or 110 pound person. Therefore, a need exists to provide an improved dampening system that is simple in construction, and that will automatically provide dampening for users in all weight ranges.

Finally, as indicated above, most treadmills include rigidly attached handrails mounted on either side of the belt to assist in balancing the user. These devices are particularly useful for beginners, older users, users with disabilities, or simply users who prefer to have a balancing aid readily available. Many users, however, are experienced and do not use these handrails, and many would prefer to simultaneously exercise their arms, e.g., by using free weights or the like. The latter is difficult with treadmills having rigidly attached handrails, since they cannot easily be moved out of the way. Accordingly, it would be desirable to provide a treadmill that includes retractable handrails that are available to those who desire to use them, and that are readily retractable for those who do not.

SUMMARY OF THE INVENTION

In accordance with the present invention, an improved treadmill is provided that includes an external frame having first and second longitudinal side rails and at least one frame cross-bar extending therebetween, and an upright frame section that extends upwardly from a first end of the longitudinal side rails. First and second rollers are rotatably mounted to the external frame and positioned so as to be substantially perpendicular to the longitudinal side rails. The first roller is coincident with a first axis. A deck is mounted on the external frame and positioned between the first and second rollers and the longitudinal side rails. An endless belt is mounted around and extends between the first and second rollers for rotation therewith, passing over the deck. A motor assembly, including a motor, and a motor shaft that is coincident with a second axis and is rotatably driven by the motor, is rotatably coupled to the first roller for rotatably driving the first roller. The treadmill also includes a flywheel assembly that is mounted on the external frame, and includes a flywheel fixedly mounted on a flywheel shaft that is coincident with a third axis. The flywheel assembly is coupled to and rotatably driven by the motor assembly.

A treadmill according to the present invention may also include first and second retractable handrails that are pivotally mounted on first and second upright support members that form part of the upright frame section. The retractable handrails are movable between an extended position in which they may provide balancing assistance to a user of the treadmill, and a retracted position.

The treadmill may also include an elevation system for adjusting the incline of the treadmill relative to the surface on which the treadmill rests. The elevation system includes a support assembly that is pivotally mounted to the external frame, and a lift assembly that is coupled to the support assembly and the external frame at six points.

Finally, the treadmill may also include first and second autodampening pads for dampening the force exerted on the deck of the treadmill by a user in any weight range. The deck is secured to the external frame at each of its four comers, and the autodampening pads are fixedly mounted on the external frame and positioned below a first and second longitudinal side of the deck.

BRIEF DESCRIPTION OF THE DRAWINGS

For a more complete understanding of the present invention and the advantages thereof, reference is now made to the following description taken in conjunction with the accompanying drawings in which like reference numbers indicate like features wherein.

DETAILED DESCRIPTION

Figure 1:
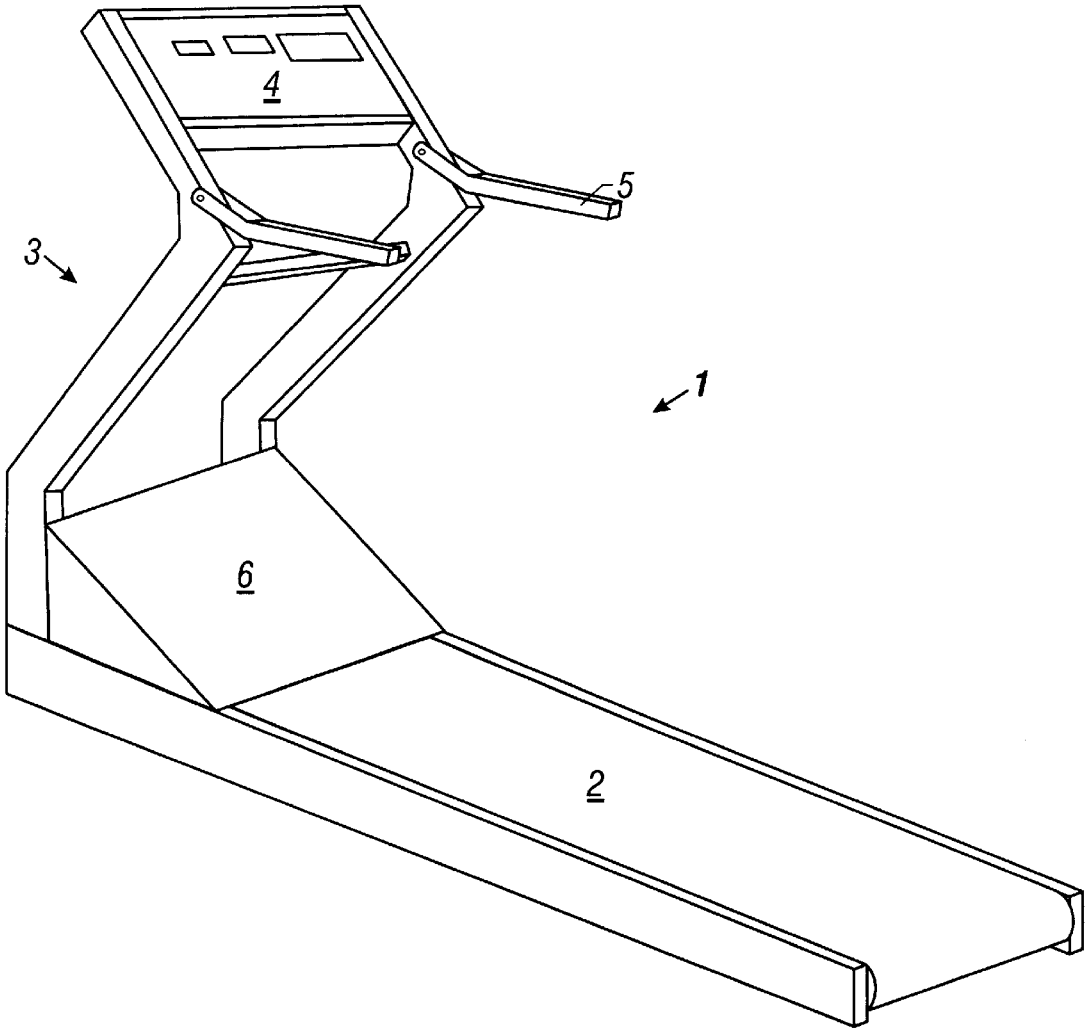
FIG. 1 is a perspective view of a treadmill according to the present invention.

FIG. 1 illustrates a motorized treadmill 1 having an endless belt 2, an external frame 3 that provides structural stability for the treadmill, a display panel 4 that displays information regarding the exercise cycle such as speed or difficulty level, retractable handrails 5, and a protective cover 6 that encases and protects the motor assembly, flywheel assembly, elevation system and various other element such as electronic circuitry and wiring.

Figure 2:
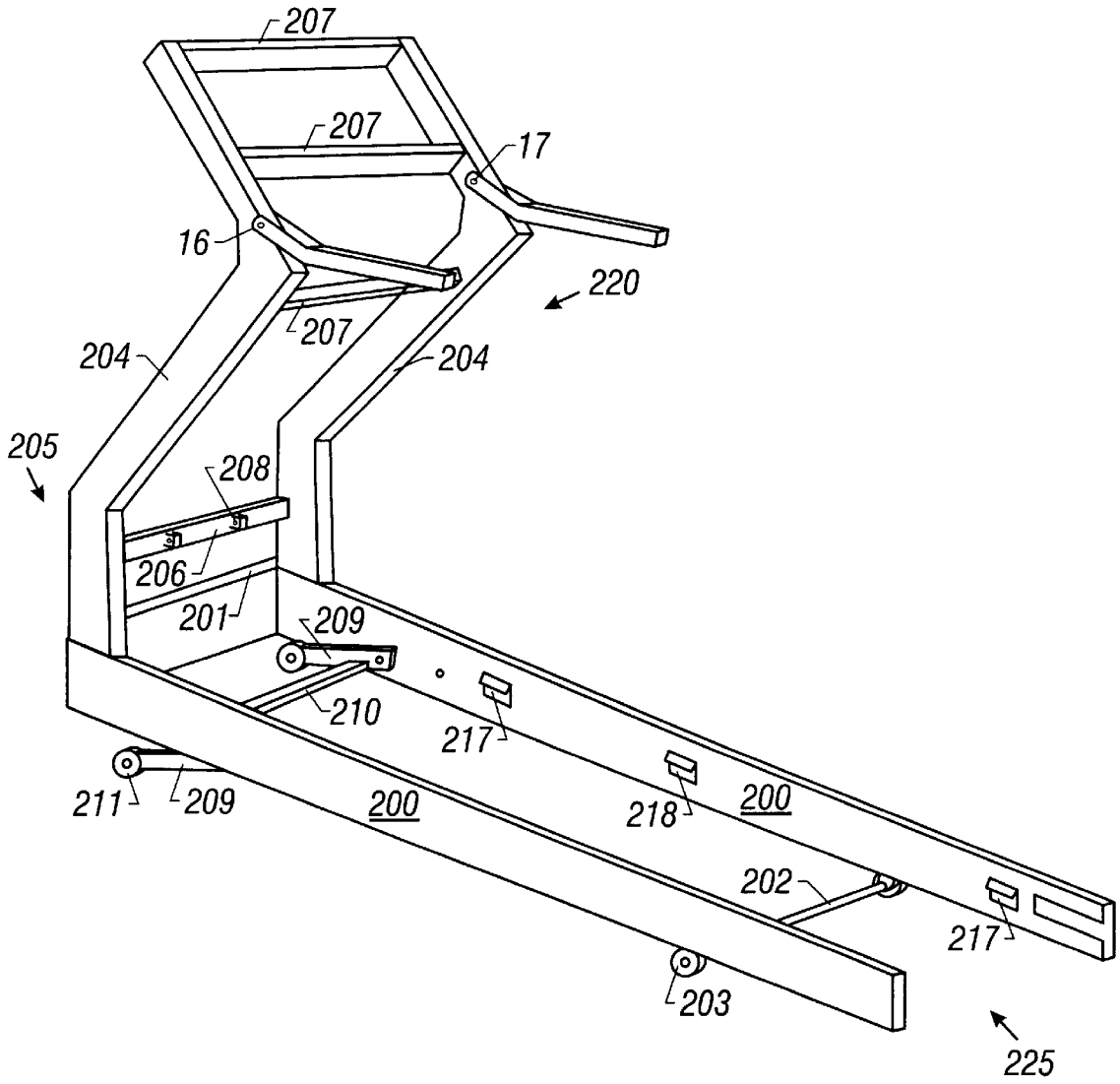
FIG. 2 is a perspective view illustrating the external frame of the treadmill and selected elements of the elevation system.

The external frame 3 comprises various elements, as shown in FIG. 2. Longitudinal side rails 200 extend longitudinally along the sides of the treadmill, and are rigidly connected together by front frame cross-bar 201. A rear bar 202 may extend between the longitudinal side rails 200, and may also serve as an axle for rear wheels 203. Additional cross-bars may also be provided at selected locations along the length of the longitudinal side rails 200. Deck mounts 217 and autodampening pad mounts 218 are either secured to or are extensions of the longitudinal side rails 200, and provide a mounting surface for the deck and autodampening pads respectively, as will be described below.

External frame 3 also includes an upright frame section 220 having two upright support members 204 that extend upwardly from the longitudinal side rails 200 at a front end 205 of the treadmill. These upright support members 204 are rigidly joined together by a lower lateral member 206, and by upper lateral members 207. Although three upper lateral members are shown in FIG. 2, either a greater number or a lesser number of upper lateral members could also be used. Further, the elements of the upright frame section could also be integrally joined rather than rigidly secured to one another. The external frame 3 further includes a support plate 420 (FIG. 4) that provides a mounting surface for securing various elements (described below) to the external frame.

Also shown in FIG. 2 are support arms 209 and support cross-bar 210 that are part of the elevation system. Protruding from lower lateral member 206 are lifting assembly supports 208 that provide the point of attachment for various other elements of the lifting assembly that will be described in further detail below with reference to FIG. 7.

Figure 3A:
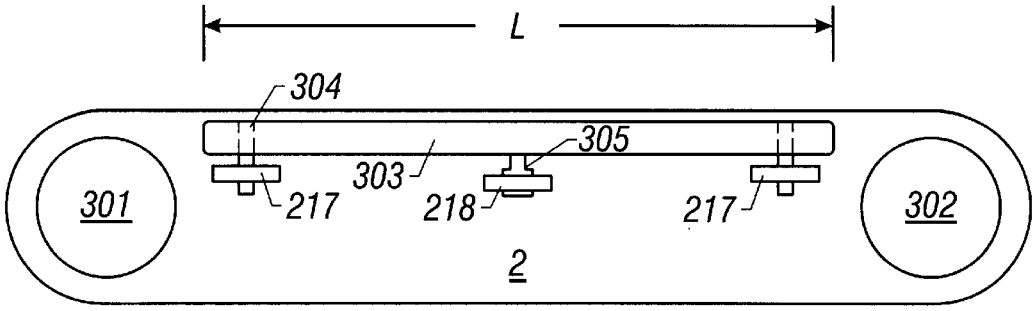
FIG. 3A is a cross-sectional view of selected portions of the treadmill belt, roller assembly and deck.

Referring now to FIG. 3A, the endless belt 2 of the treadmill 1 is mounted around and extends between a front roller 301 positioned toward the front end 205 of the treadmill, and a rear roller 302 positioned toward the rear end 225 of the treadmill. Front roller 301 and rear roller 302 are substantially parallel and spaced apart, and are rotatably mounted on and positioned between longitudinal side rails 200. The endless belt 2 is rotatable with front roller 301 and rear roller 302. Also mounted on the external frame 3 between the front roller 301 and rear roller 302 is a support deck 303 made of wood or other suitable material. This support deck is attached by bolts 304, or otherwise securely fixed, to deck mounts 217 at each of its four comers, and is also supported by two autodampening pads 305 that are secured to autodampening pad mounts 218 and positioned on opposite sides of the support deck approximately midway along the length L of the support deck. The deck mounts 217 and autodampening pad mounts 218 can be either separate elements that are secured to the longitudinal side rails 200, or integral with the longitudinal side rails.

Figure 4:
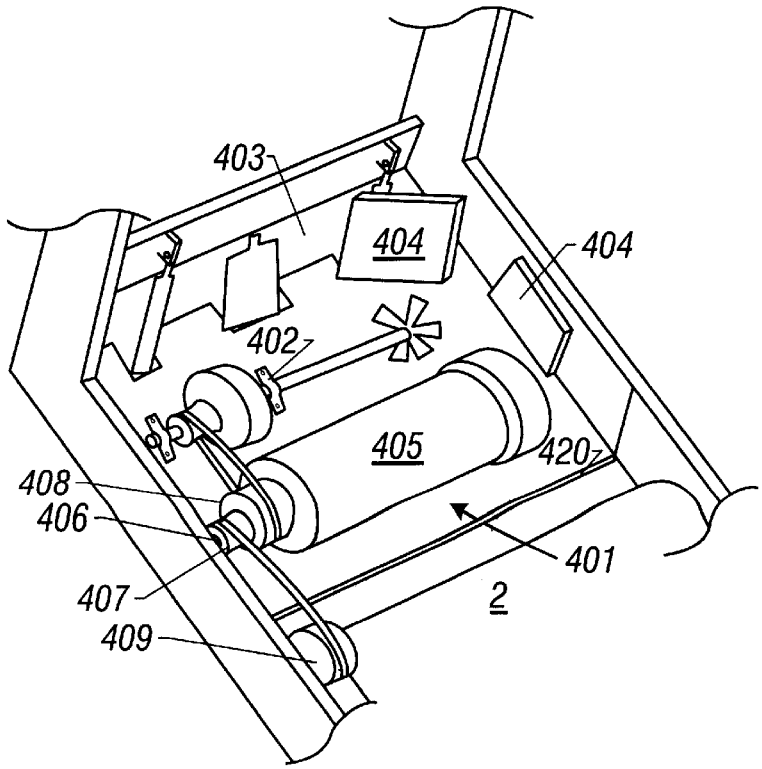
FIG. 4 is a perspective view illustrating the motor assembly, the flywheel assembly, and selected other components that are mounted at the front end of the treadmill.

Positioned between the front roller 301 and the front frame cross-bar 201 are the motor assembly 401, the flywheel assembly 402, the elevation system 403, and various electronic circuitry and wires 404, as is shown in FIG. 4. In one embodiment, a support plate 420 provides a mounting surface for various elements that are located under the protective cover 6, such as the motor assembly.

The motor assembly 401 comprises a motor 405, and a motor shaft 406 having a first enlarged portion 407 and a second enlarged portion 408. The first and second enlarged portions 407, 408 may be integrally joined to the motor shaft 406, or may consist of separate disk-shaped elements that are fixedly mounted on the motor shaft. As shown in FIG. 4, the front roller 301 also includes an enlarged portion 409, or a disk-shaped element mounted thereon, that extends beyond the endless belt 2. Any motor having sufficient power to drive the endless belt and rollers, and having an adequate life may be used. One such motor is a two horsepower motor rated at 3400 revolutions per minute, and manufactured by Baldor Electric Co. of Fort Smith, Ark.

Figure 5:
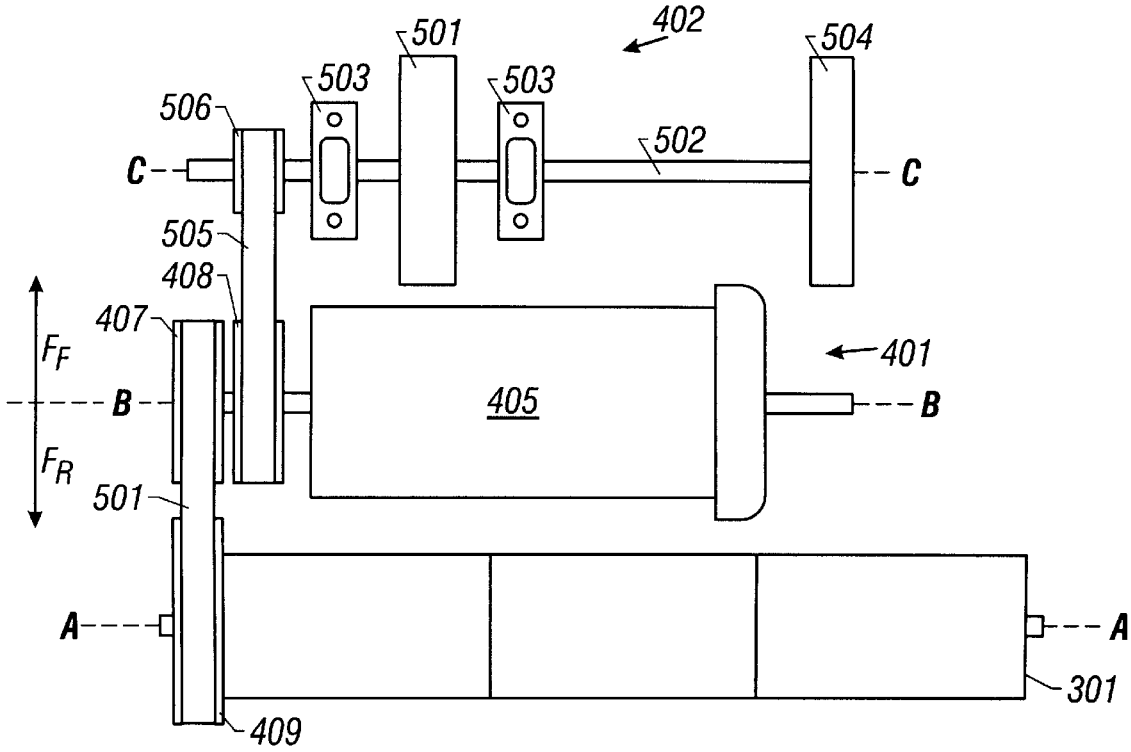
FIG. 5 is a top view illustrating the interconnection between the motor assembly, the front roller and the flywheel assembly.

Referring now to FIG. 5, the motor assembly 401 and flywheel assembly 402 will now be described in greater detail. Motor assembly 401 is rotatably coupled to the front roller 301 by a first endless pulley belt 501 that is mounted around and extends between the enlarged portion 409 of the front roller 301 and the first enlarged portion 407 of the motor shaft 406. The first endless pulley belt 501 is tightly fitted so that when the motor causes the motor shaft to rotate it will also rotatably drive the front roller. The first roller 301 is coincident with a first axis A, and the motor shaft 406 of motor assembly 401 is coincident with a second axis B.

The flywheel assembly 402 is also rotatably coupled to the motor assembly 401. The flywheel assembly consists of a flywheel 501 that is fixedly mounted on a separate flywheel shaft 502 that is coincident with a third axis C. Flywheel 501, however, could also be formed as an integral part of flywheel shaft 502, such as an enlarged portion of the shaft. In one embodiment, flywheel 501 is made of steel or cast iron, weighs approximately 30 lbs, and is positioned between two pillow block bearings 503. These pillow block bearings preferably are lined with rubber so as to dampen vibrations of the flywheel assembly. Further, in one embodiment a fan 504 is mounted at one end of the flywheel shaft 502. The fan 504 provides convection cooling for the electronic circuitry 404 that is mounted under the protective cover 6 of the treadmill. The flywheel assembly is rotatably coupled to the motor through a second endless pulley belt 505 that is mounted around and extends between the second enlarged portion 408 of motor shaft 406, and an enlarged portion 506 of flywheel shaft 502. Enlarged portion 506 may also be a separate disk-shaped element that is mounted on flywheel shaft 502. Enlarged portion 506 may also be a variable speed pulley, to allow for "on the fly" ratio changes.

Because the flywheel assembly is uniquely mounted on a shaft that is separate and apart from both the motor shaft 406 and the front roller 301, significant advantages are achieved. First, by removing the flywheel from the motor shaft, the flywheel can rotate at a faster rate simply by changing the relative diameters of the enlarged portion 506 of the flywheel shaft and the second enlarged portion 408 of the motor shaft in a manner analogous to changing the gear ratio in a gear assembly. By rotating at a faster rate, the flywheel creates additional inertial forces that counteract the tendency of the motor to slow down during each footstep of the user, thereby further improving the fluid motion of the belt. Preferably, the flywheel 501 is driven at from 1.5 to 5 times the rotational speed of the motor. Even when driven at the same or a slower speed, however, because the flywheel is mounted on a shaft other than the motor shaft, the flywheel will nevertheless function to reduce the load on the motor as described below. A variable speed pulley, if used, could allow for the ratio to change as the motor speed changes.

Another advantageous feature of the flywheel assembly of the present invention is that it substantially reduces the load imposed on the motor via the motor shaft since the flywheel is mounted on a separate shaft. Under normal operation, when the motor is driving the front roller 301 and endless belt 2, a significant unidirectional load is imposed on the motor shaft 406. The direction of this load is illustrated by $F_R$ in FIG. 5. This load is transferred to the motor bearings, and the greater the amount of the load, the shorter the life of the bearings. Further, a flywheel that is mounted directly on the motor shaft creates an additional overhang load on the motor shaft and the motor bearings.

As shown in FIG. 5, the flywheel shaft 502 is preferably mounted parallel to both the motor shaft 406 and the front roller 301, but on the opposite side of the motor from the front roller 301. In this manner, the flywheel assembly 402 also creates a unidirectional load on the motor shaft 406, as is shown by $F_F$ in FIG. 5. The direction of this force, however, is opposite to that of the load imposed by the roller and belt ($F_R$), causing the opposite forces to substantially cancel each other out, and essentially neutralizing the load on the motor.

Although in a preferred embodiment the flywheel shaft 502 is parallel to and opposite from the front roller 301, it may also be positioned so that it is either non-parallel or not entirely opposite from the front roller 301. Although these configurations do not counteract the load imposed on the motor by the front roller and belt in the most effective manner, they will nevertheless reduce the load.

The treadmill 1 also includes various other unique features, such as retractable handrails, and an automatic dampening system that automatically adjusts to dampen the impact of a user's footstep on the deck of the treadmill for all users regardless of their weight.

Figure 6:
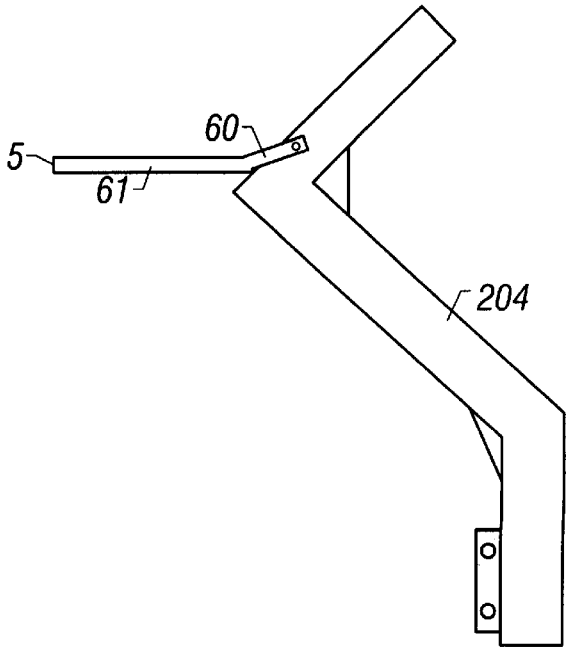
FIG. 6A illustrates the treadmill handrail in its extended position.
FIG. 6B illustrates the treadmill handrail in its retracted position.

The retractable handrails 5 of treadmill 1 are shown in FIGS. 1, 6A, and 6B. Each handrail 5 is pivotally mounted to a respective upright support member 204 of the upright frame section 220. A pin 16 and a retainer 17 (FIG. 1) are used to pivotally mount the retractable handrails on the upright support members 204, but any other suitable means could be used as well. The retractable handrails 5 each include a connecting portion 60 that is pivotally connected to the upright support member 204, and a support portion 61 that serves to provide support for the user when in the extended position.

In the extended position, as shown in FIGS. 1 and 6A, the retractable handrails extend so that the support portion 61 is substantially parallel to and substantially positioned above the longitudinal side rails 200. The retractable handrails 5 are movable between this extended position, and a retracted position in which they are not positioned substantially parallel to the longitudinal side rails 200. In one embodiment the retractable handrails in the retracted position are positioned against the upright support members 204 as shown in FIG. 6B. The retractable nature of the handrails enables them to be moved out of the way so that they are no longer positioned on either side of the user. The user is then able to use the free space to simultaneously exercise the arms, such as by using dumbbells or the like, or for any other purpose. Other retracted positions, such as lowering rather than raising the handrails, are also possible so long as they are retracted out of the way of the user.

The autodampening mechanism of treadmill 1 will now be described with reference to FIGS. 3A and 3B. As indicated, the deck 303 of the treadmill 1 is rigidly attached by bolts 304 or the like to the deck mounts 217 at each of its four corners. In addition, positioned under either longitudinal side of the deck 303 approximately midway along the length L of the deck are two autodampening pads 305. The deck 303 simply rests on and is partially supported by the autodampening pads 305. The undersides of the autodampening pads 305 are securely attached to the autodampening pad mounts 218.

Figure 3B:
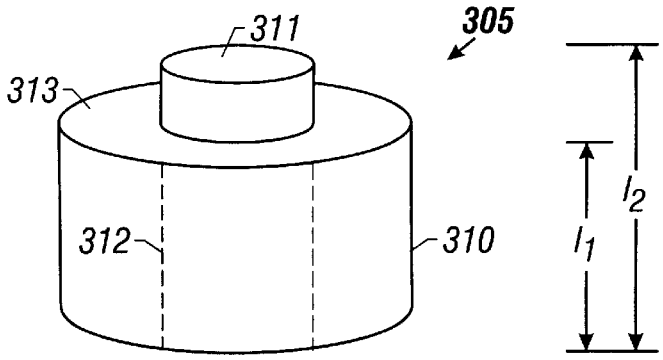
FIG. 3B illustrates an autodampening pad.

Referring now to FIG. 3B, the autodampening pads 305 include a first pad member 310 and a second pad member 311. In one embodiment the first pad member 310 is cylindrical in shape, and has a cylindrical hole 312 therethrough. The second pad member 311 is also cylindrical in shape, and is of such a diameter that it fits snugly within the cylindrical hole 312 in the first pad member 310. The second pad member 311, however, has a length $l_2$ that is greater than the length $l_1$ of the first pad member 310 so that it protrudes beyond the top surface 313 of the first pad member.

The first pad member is preferably made of a high density compressible material, such as 30 lb. compression rubber, and the second pad member is preferably made of a lower density compressible material, such as 10 lb. compression rubber. The difference in length of the first pad member in this embodiment and the second pad member is approximately 0.25 inches. Because the second pad member 311 both consists of a lower density material and protrudes beyond the upper surface of the first pad member, it will provide initial dampening against any forces exerted on the treadmill deck 303. For a lightweight user, the lower density material of the second pad member provides sufficient dampening. For a heavy user, however, the lower density inner pad member 311 is insufficient. Under such circumstances, the second pad member 311 will become compressed under the force of a heavy user, and the surrounding first pad member 310 will eventually begin to bear some of the load. Because the first member is a higher density material, it provides the additional dampening necessary for heavier users. Thus, the combination of a lower density material and a higher density material and the differences in the length between the first and second pad members ensures that both a light weight user and a heavier user will experience sufficient dampening. Different configurations of the pad members, and different types of material may also be used, so long as the autodampening pads function according to the principles described above.

The autodampening pads 305 also reduce the springback force experienced by the user. In many treadmills, autodampening elements tend to dampen the impact of a user's footstep, but once the force is removed the autodampening elements tend to spring back quickly, exerting what is known as a springback force on the deck. When the force of the user's footstep is removed from the autodampening pads 305, however, the first pad member 310 tends to first exert a force radially inwardly against the second pad member 311, rather than upwardly against the deck 303. In this manner, the immediate upward springback force is substantially reduced.

Figure 7:
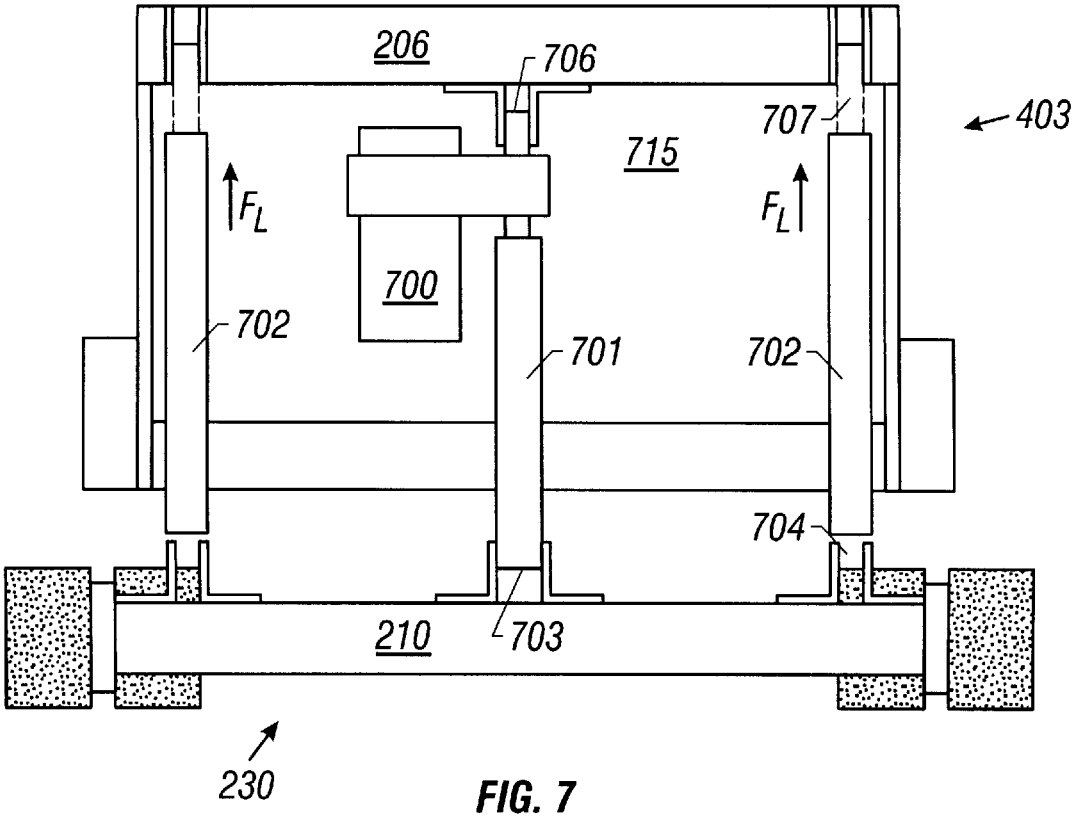
FIG. 7 is a front view of the elevation system according to the present invention.

Another unique feature of the treadmill of the present invention is the six-point elevation system it employs. The elevation system 403 includes a support assembly 230 (FIGS. 2 and 7) and a lift assembly 715 (FIG. 7). The support assembly 230 shown in FIG. 2 includes two lifting arms 209 that are each pivotally mounted at one end to a respective one of the longitudinal side rails 200. Extending between and securely attached to the two support arms 209 is a support cross-bar 210. Wheels 211 or the like may also be attached to the support arms 209.

The lifting assembly includes a lift motor 700 that drives a linear actuator 701, and two gas lift cylinders 702. A bottom end 703 of the motor driven linear actuator 701, and a bottom end 704 of each of the gas lift cylinders 702 are pivotally connected to the support cross-bar 210 of the support assembly of the elevation system 403. An upper end 706 of the motor driven linear actuator and an upper end 707 of each of the gas lift cylinders are pivotally connected to the lifting assembly supports 208 of the lower lateral member 206 of the external frame 3. The upper ends 707 could, however, also be secured directly to the lower lateral member 206. Because the support crossbar 210 is rigidly secured to the support arms 209, which in turn are pivotally mounted on the longitudinal side rails 200 (FIG. 2), movement of the linear actuator 701 causes the external frame 3 to move vertically relative to the support cross-bar 210. Thus, the incline of the external frame 3, including the deck and endless belt, of the treadmill can be adjusted relative to the floor it rests on by means of elevation system 403.

The gas lift cylinders 702 continuously exert a lifting force $F_L$ on the lower lateral member 206, urging the external frame 3 to an inclined position. The motor 700 and linear actuator 701 counteract the lifting force $F_L$ at all times. When the elevation of the treadmill is to be adjusted, the motor 700 forces the linear actuator to either expand, thereby allowing the lifting force $F_L$ to raise the treadmill, or to contract against the lifting force $F_L$ to reduce the incline of the treadmill.

This unique arrangement of the elevation system 403 provides several advantages. First, because the elevation system is secured to the treadmill 1 at six points it provides superior stability over prior two or four point systems. Second, by using a single motor driven linear actuator that is separate and independent of the lifting elements (the gas lift cylinders), an elevation system is provided that will not seize up if one of the lifting elements fails to function properly. Further, proper functioning does not depend on the synchronous operation of both lifting elements. Accordingly, the elevation system is more stable and more reliable.

The treadmill of the present invention as described above, includes several unique and advantageous features. Other modifications of the invention described above will be obvious to those skilled in the art, and it is intended that the scope of the invention be limited only as set forth in the appended claims.

What is claimed is:

1. A motorized treadmill comprising:

a.) an external frame having first and second longitudinal side rails and at least one frame cross-bar extending therebetween, and an upright frame section extending upwardly from a first end of said first and second longitudinal side rails;

b.) first and second rollers rotatably mounted on said external frame and positioned between and substantially perpendicular to said first and second longitudinal side rails, said first roller being coincident with a first axis;

c.) a deck mounted on said external frame and positioned between said first and second longitudinal side rails and between said first and second rollers;

d.) an endless belt mounted around and extending between said first and second rollers for rotation therewith;

e.) a motor assembly mounted on said external frame, said motor assembly including a motor, and a motor shaft that is coincident with a second axis and is rotatably driven by said motor, said motor assembly being coupled to said first roller for rotatably driving said first roller;

f.) a flywheel assembly mounted on said support frame, said flywheel assembly including a flywheel shaft that is coincident with a third axis, a flywheel fixedly mounted on said flywheel shaft, said flywheel shaft being coupled to and rotatably driven by said motor assembly, wherein said third axis is located on one side of said second axis, and said first axis is located on an opposite side of said second axis.

2. A motorized treadmill according to claim 1, wherein said flywheel assembly further comprises a fan mounted on said flywheel shaft.

3. A motorized treadmill according to claim 1, wherein said motor assembly is rotatably coupled to said first roller by a first endless pulley belt, said first endless pulley belt being mounted around a first enlarged portion of said motor shaft and around a first enlarged portion of said first roller, and extending therebetween.

4. A motorized treadmill according to claim 3, wherein said motor assembly is rotatably coupled to said flywheel assembly by a second endless pulley belt, said second endless pulley belt being mounted around a second enlarged portion of said motor shaft and around a first enlarged portion of said flywheel shaft, and extending therebetween.

5. A motorized treadmill according to claim 4, wherein said first enlarged portion of said motor shaft further comprises a substantially disk shaped element fixedly mounted on said motor shaft.

6. A motorized treadmill according to claim 4, wherein said first enlarged portion of said first roller further comprises a substantially disk shaped element fixedly mounted on said first roller.

7. A motorized treadmill according to claim 4, wherein said second enlarged portion of said motor shaft further comprises a substantially disk shaped element fixedly mounted on said motor shaft.

8. A motorized treadmill according to claim 4, wherein said first enlarged portion of said flywheel shaft further comprises a substantially disk shaped element fixedly mounted on said flywheel shaft.

9. A motorized treadmill according to claim 4, wherein said flywheel is an enlarged portion of said flywheel shaft.

10. A motorized treadmill according to claim 4, wherein said flywheel is a substantially disk shaped element fixedly mounted on said flywheel shaft.

11. A motorized treadmill according to claim 4, wherein said first, second and third axes are substantially parallel.

12. A motorized treadmill according to claim 11, wherein said flywheel assembly further comprises first and second bearings each fixedly mounted on said external frame and having an annular hole therethrough, said flywheel being positioned between said first and second bearings, and said flywheel shaft extending through said annular holes in said first and second bearings.

13. A motorized treadmill comprising:

a.) an external frame having first and second longitudinal side rails, at least one frame crossbar extending therebetween and an upright frame section extending upwardly from a first end of said first and second side rails, said upright frame section including first and second upright support members extending upwardly from a front end of said first and second longitudinal side rails respectively, and at least one upper lateral member extending therebetween;

b.) first and second rollers rotatably mounted on said external frame and positioned between and substantially perpendicular to said first and second longitudinal side rails;

c.) a deck mounted on said external support frame and positioned between said first and second longitudinal side rails and between said first and second rollers;

d.) an endless belt mounted around and extending between said first and second rollers for rotation therewith;

e.) a motor assembly mounted on said external frame, said motor assembly including a motor and a motor shaft that is rotatably driven by said motor, said motor assembly being coupled to said first roller for rotatably driving said first roller; and f.) first and second retractable handrails pivotally mounted on said first and second upright support members respectively, and movable between a first position wherein said retractable handrails may provide balancing assistance for a user of said treadmill, and a retracted position, said first and second retractable handrails comprising a supporting portion and a connecting portion wherein in said first position said supporting portion of said first and second retractable handrails are substantially parallel to and positioned substantially above said first and second longitudinal side rails respectively, and in said retracted position said supporting portion of said first and second retractable handrails are positioned substantially against said upright support members of said upright frame section.

14. A motorized treadmill comprising:

a.) an external frame having first and second longitudinal side rails and at least one frame cross-bar extending therebetween, an upright frame section extending upwardly from a first end of said first and second longitudinal side rails, said upright frame section including first and second upright support members extending upwardly from a first end of said first and second longitudinal side rails respectively, and at least one upper lateral member and a lower lateral member extending between said upright support members;

b.) first and second rollers rotatably mounted on said external frame and positioned between and substantially perpendicular to said first and second longitudinal side rails;

c.) a deck mounted on said support frame and positioned between said first and second side rails and between said first and second rollers;

d.) an endless belt mounted around and extending between said first and second rollers for rotation therewith;

e.) a motor assembly mounted on said external frame, said motor assembly including a motor and a motor shaft that is rotatably driven by said motor, said motor assembly being coupled to said first roller for rotatably driving said first roller; and f.) an elevation system for adjusting an incline of said external frame relative to a surface on which said treadmill rests, said elevation system including a support assembly pivotally connected to said external frame, and a lift assembly coupled to said support assembly and said external frame at six points.

15. A motorized treadmill according to claim 14, wherein said support assembly further comprises first and second support arms pivotally mounted at a first end to said first and second longitudinal side rails respectively, and a support cross-bar rigidly attached at a first end to said first support arm and at a second end to said second support arm.

16. A motorized treadmill according to claim 15, wherein said lift assembly further comprises a lifting motor, a linear actuator driven by said lifting motor, a first lifting element and a second lifting element, said linear actuator and said first and second lifting elements each having a first end coupled to said support cross-bar and a second end coupled to said lower lateral member of said external frame, said linear actuator being positioned substantially centrally along said support cross-bar and lower lateral member, and said first and second lifting elements being positioned on opposite sides of said linear actuator.

17. A motorized treadmill according to claim 16, wherein said first and second lifting elements exert a lifting force on said external frame tending to lift up a front end of said external frame, and said lifting motor and linear actuator being capable of counteracting said lifting force to adjust the vertical position of the front end of said treadmill.

18. A motorized treadmill according to claim 17, wherein said first and second lifting elements a repressurized gas cylinders.

19. A motorized treadmill comprising:

a.) an external frame having first and second longitudinal side rails and at least one frame cross-bar extending therebetween, and an upright frame section extending upwardly from a first end of said first and second longitudinal side rails;

b.) first and second rollers rotatably mounted on said external frame and positioned between and substantially perpendicular to said first and second longitudinal side rails;

c.) an endless belt mounted around and extending between said first and second rollers for rotation therewith;

d.) a motor assembly mounted on said external frame, said motor assembly including a motor and a motor shaft that is rotatably driven by said motor, said motor assembly being coupled to said first roller for rotatably driving said first roller;

e.) a deck mounted on said external frame and positioned between said first and second longitudinal side rails and between said first and second rollers, said deck having four corners, a first longitudinal side and a second longitudinal side, and being fixedly attached to said external frame at each of said four corners; and f.) at least first and second autodampening pads for dampening a force exerted on said deck by any user, said first autodampening pad being fixedly mounted to said external frame and positioned below said first longitudinal side of said deck, and said second autodampening pad being fixedly mounted on said external frame and positioned below said second longitudinal side of said deck; said at least first and second autodampening pads each having first and second pad members, said first pad member having an upper surface, a lower surface, and an aperture therethrough, said second pad member being located within said aperture of said first pad member and having a length such that it protrudes beyond said upper surface of said first pad member so as to provide initial support for said deck when said force is exerted on said deck, said first pad member providing support for said deck only if said exerted force exceeds a predetermined magnitude.

20. A motorized treadmill according to claim 19, wherein said first pad member is made of a compressible material having a first density, and said second pad member is made of a compressible material having a lower density.

21. A motorized treadmill according to claim 20, wherein said first and second pad members are substantially cylindrical in shape.

22. A motorized treadmill comprising:

a.) an external frame having first and second longitudinal side rails and at least one frame cross-bar extending therebetween, and an upright frame section extending upwardly from a first end of said first and second longitudinal side rails;

b.) first and second rollers rotatably mounted on said external frame and positioned between and substantially perpendicular to said first and second longitudinal side rails;

c.) an endless belt mounted around and extending between said first and second rollers for rotation therewith;

d.) a motor assembly mounted on said external frame, said motor assembly including a motor and a motor shaft that is rotatably driven by said motor, said motor assembly being coupled to said first roller for rotatably driving said first roller;

e.) a deck mounted on said external frame and positioned between said first and second longitudinal side rails and between said first and second rollers, said deck having four corners, a first longitudinal side and a second longitudinal side, and being fixedly attached to said external frame at each of said four corners; and f) at least first and second autodampening pads for dampening a force exerted on said deck by any user, said first autodampening pad being fixedly mounted to said external frame and positioned below said first longitudinal side of said deck, and said second autodampening pad being fixedly mounted on said external frame and positioned below said second longitudinal side of said deck; said at least first and second autodampening pads each having first and second pad members having first and second different densities, said second pad member providing dampening against said force, and said first pad member providing additional dampening against said force only if said force exceeds a predetermined magnitude.

* * * * *